US009807507B1

(12) United States Patent
Liu et al.

(10) Patent No.: US 9,807,507 B1
(45) Date of Patent: Oct. 31, 2017

(54) ELECTRONIC ACCESSORY APPARATUS AND AUDIBLE SIGNAL TRANSMISSION METHOD THEREOF

(71) Applicant: HTC Corporation, Taoyuan (TW)

(72) Inventors: Cheng-Hsi Liu, Taoyuan (TW); Kuo-Pin Fang, Taoyuan (TW); Wei-Syuan Lin, Taoyuan (TW); Ching-Jung Tsai, Taoyuan (TW)

(73) Assignee: HTC Corporation, Taoyuan (TW)

( * ) Notice: Subject to any disclaimer, the term of this patent is extended or adjusted under 35 U.S.C. 154(b) by 0 days.

(21) Appl. No.: 15/294,795

(22) Filed: Oct. 17, 2016

(51) Int. Cl.
*H04R 3/12* (2006.01)
*H01R 24/60* (2011.01)

(52) U.S. Cl.
CPC ..... *H04R 3/12* (2013.01); *H01R 24/60* (2013.01); *H04R 2420/09* (2013.01)

(58) Field of Classification Search
CPC . H04R 3/00; H04R 3/13; H04R 27/00; H04R 29/07; H04R 2420/03; H04R 2420/01; H04R 3/12; H04S 7/30
USPC ..... 381/81, 80, 85, 91
See application file for complete search history.

(56) References Cited

U.S. PATENT DOCUMENTS

2016/0142810 A1* 5/2016 Freitas ..... H04R 1/1041 381/74

FOREIGN PATENT DOCUMENTS

TW 573885 1/2004
TW I302048 10/2008

OTHER PUBLICATIONS

"Office Action of Taiwan Counterpart Application," dated Aug. 21, 2017, pp.1-6, in which the listed references were cited.

* cited by examiner

*Primary Examiner* — Melur Ramakrishnaiah
(74) *Attorney, Agent, or Firm* — Jianq Chyun IP Office

(57) ABSTRACT

An electronic accessory apparatus and audible signal transmission method thereof are provided. The electronic accessory apparatus includes a type C USB connector, a first switch circuit, a second switch circuit, a grounding switch circuit and a first channel selector. The type C USB connector has a plurality of data pin sets, a first ground pin, and a second ground pin. The first switch circuit transports a data signal set or an audible output signal set to a first selected data pin set according to a first control signal. The second switch circuit transports the audible output signal set to the first selected data pin set according to the first control signal. The grounding switch circuit is turned on or cut off according to a second control signal. The first channel selector sets a signal transmission relation between the first audible input signal set and the first and second ground pins.

13 Claims, 4 Drawing Sheets

ELECTRONIC ACCESSORY APPARATUS AND AUDIBLE SIGNAL TRANSMISSION METHOD THEREOF

BACKGROUND OF THE INVENTION

1. Field of the Invention

The present invention generally relates to an electronic accessory apparatus and an audio signal transmission method thereof, in particular, to an electronic accessory apparatus and an audio signal transmission method thereof with improved audio signal quality.

2. Description of Related Art

Along with the progress in electronic technology, electronic devices have become necessary equipment in people's lives. In addition, the requirement on the performance exhibited by the electronic devices has become higher.

Concerning the requirement of high audio quality, 3 microphones are required in a headphone to accomplish high quality audio signal transmission operations. However, the audio signal transmission of only a single microphone is supported in the present type C USB, thus the requirement of users cannot be satisfied. Moreover, concerning an aspect of audio play, when the equivalent impedance of the audio signal transmission channels provided by the type C USB is excessively high, the audio quality would be lowered as well, so that the requirement of users cannot be satisfied.

SUMMARY OF THE INVENTION

An electronic accessory apparatus and an audio signal transmission method are provided with improved audio signal quality.

The electronic accessory apparatus of the present invention includes a type C USB connector, a first switch circuit, a second switch circuit and a first channel selector. The type C USB connector has a plurality of data pin sets, a first ground pin and a second ground pin. The first switch circuit is coupled to a first selected data pin set among the data pin sets, and transmits a data signal set or an audio output signal set to the first selected data pin set according to a first control signal. The second switch circuit is coupled to the first selected data pin set, and transmits the audio output signal set to the first selected data pin set according to the first control signal. The grounding switch circuit is coupled between the first ground pin, the second ground pin and a reference ground, and turned on or cut off according to a second control signal. The first channel selector is coupled to the first ground pin and the second ground pin, and sets a signal transmission relation between a first audio input signal set, the first ground pin and the second ground pin.

The audio signal transmission method in the present invention includes: providing a type C USB connector, wherein the type C USB connector has a plurality of data pin sets, a first ground pin and a second ground pin; providing a first switch circuit and a second switch circuit to receive an audio output signal set together, and transmitting the audio output signal set to a first selected data pin set among the data pin sets via the first switch circuit and the second switch circuit according to a first control signal; providing a grounding switch circuit to electrically conduct or isolate a reference ground and the first ground pin and the second ground pin according to a second control signal; and, transmitting a first audio input signal set via a first channel selector.

As above, by providing the second switch circuit, the grounding switch circuit and the first channel selector, and operating in coordination with the type C USB connector in the present invention, an impedance of the transmission of the audio output signal set is lowered and the number of transmission channels for transmitting the audio input signal set is increased. As a result, the quality of the audio signal transmitted via the electronic accessory apparatus can be improved effectively.

To make the afore-mentioned and other features and advantages of the invention more comprehensible, several embodiments accompanied with figures are described in detail below.

DESCRIPTION OF THE EMBODIMENTS

Figure 1:
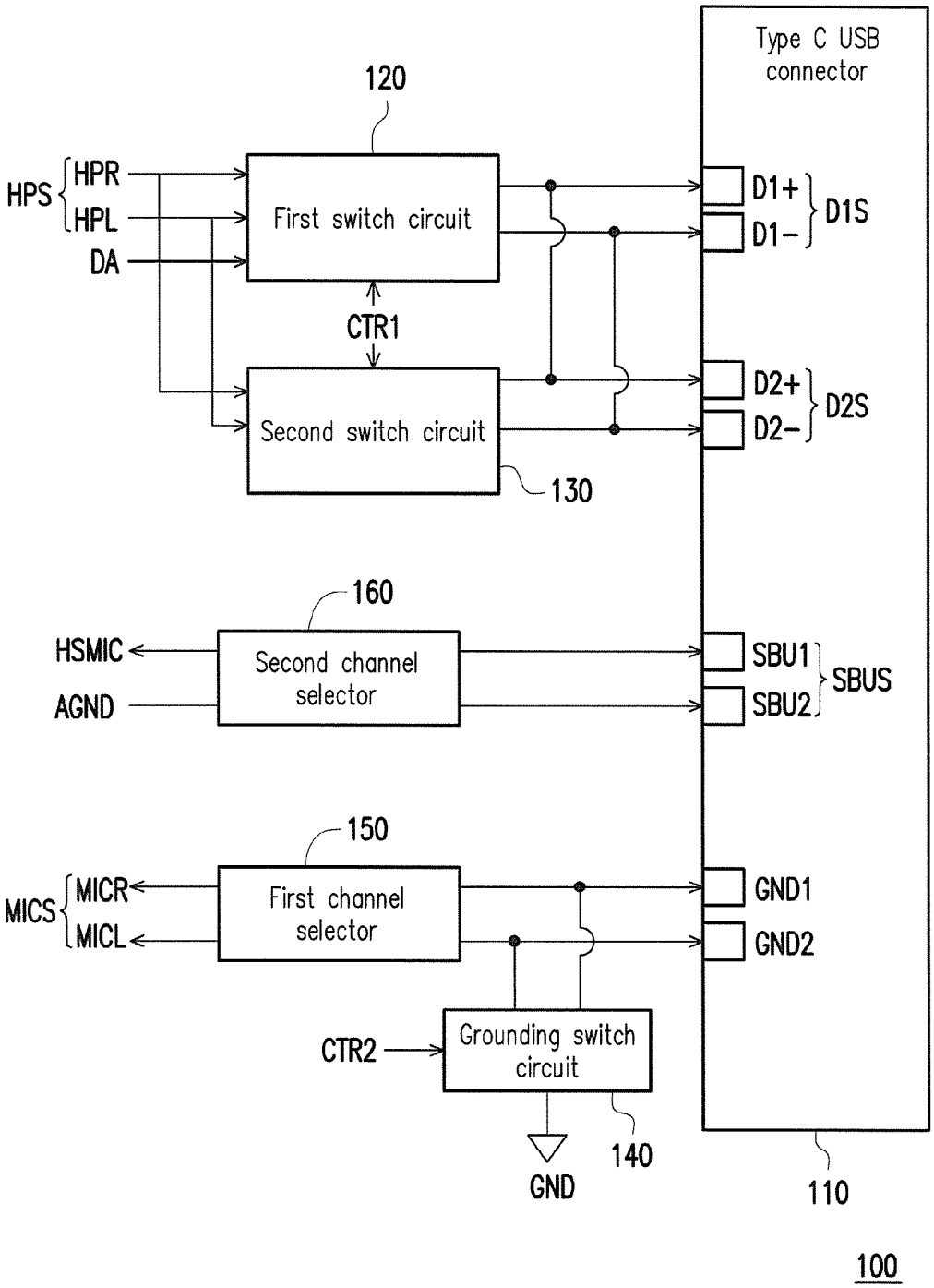
FIG. 1 is a schematic diagram illustrating an electronic accessory apparatus according to an embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

Please refer to FIG. 1, FIG. 1 is a schematic diagram illustrating an electronic accessory apparatus according to an embodiment of the present invention. The electronic accessory apparatus 100 includes a type C USB (Type C universal serial bus, Type C USB) connector 110, a first and second switch circuits 120, 130, a grounding switch circuit 140, a first channel selector 150 and a second channel selector 160. The type C USB connector 110 has a plurality of data pin sets D1S, D2S, a sideband use pin set SBUS and ground pins GND1, GND2. In the present embodiment, the data pin set D1S has data pins D1+, D1−, the data pin set D2S has data pins D2+, D2−, and the sideband use pin set SBUS has sideband use pins SBU1, SBU2.

In the present embodiment, the first switch circuit 120 and the second switch circuit 130 are coupled to the data pin set D1S together. In addition, the first switch circuit 120 and the second switch circuit 130 commonly receive an audio output signal set HPS, wherein the audio output signal set HPS includes an audio output signal HPR and an audio output signal HPL. Furthermore, the first switch circuit 120 further receives a data signal set DA. The first switch circuit 120 can determine either to transmit the data signal set DA to the data pin set D1S or transmit the audio output signal set HPS to the data pin set D1S according a control signal CTR1. The second switch circuit 130 can determine whether to transmit the audio output signal set HPS to the data pin set D1S or not according to the control signal CTR1. Specifically, when the audio output signal set HPS is transmitted to the data pin set D1S via the first switch circuit 120 according to the control signal CTR1, the audio output signal set HPS is transmitted to the data pin set D1S via the second switch circuit 130 according to the control signal CTR1. Correspondingly, when the data signal set DA is transmitted via the first switch circuit 120 according to the control signal CTR1, the audio output signal set HPS is not transmitted via the second switch circuit 130.

As a result, when the audio output signal set HPS is transmitted, two transmission channels are formed by the first and second switch circuits 120, 130 to transmit the audio output signal set HPS. Therefore, an equivalent impedance of the transmission channels for transmitting the audio output signal set HPS is equal to an impedance of parallel impedances provided by the first switch circuits 120, 130, that is, the equivalent impedance of the transmission channels for transmitting the audio output signal set HPS is lowered effectively. A transmission efficiency of the audio output signal set HPS can be improved effectively, and an audio quality generated according to the audio output signal set HPS can be improved as well.

On the other hand, in the present embodiment, output ends of the first and second switch circuits 120, 130 are coupled to each other, and are coupled to the other data pin set D2S. In other words, the audio output signal set HPS can be obtained at the data pin sets D1S, D2S simultaneously.

In addition, the grounding switch circuit 140 is coupled between the two different ground pins GND1, GND2 of the type C USB connector 110 and the reference ground GND. The first channel selector 150 is coupled to the ground pins GND1, GND2, and receives an audio input signal set MICS. In particular, when a transmission operation is not performed by the first channel selector 150, the ground pins GND1, GND2 can be coupled to the reference ground GND via the grounding switch circuit 140 according to the control signal CTR2. Correspondingly, when the first channel selector 150 is required to perform the transmission operation of the audio input signal set MICS, the ground pins GND1, GND2 can be electrically isolated from the reference ground GND via the grounding switch circuit 140 according to the control signal CTR2.

In the present embodiment, a transmission relation between audio input signals MICR, MICL and the ground pins GND1, GND2 can be set by the first channel selector 150. Specifically, in a first mode (e.g. when a microphone is connected with the type C USB connector 110 in a first direction), the audio input signals MICR, MICL can be respectively received from the ground pins GND1, GND2 via the first channel selector 150. Correspondingly, in a second mode (e.g. when a microphone is connected with the type C USB connector 110 in a second direction opposite to the first direction), the audio input signals MICR, MICL can be respectively received from the ground pins GND1, GND2 via the first channel selector 150.

On the other hand, in an embodiment of the present invention, the second channel selector 160 is coupled to the sideband use pin set SBUS, and receives an audio input signal HSMIC by using one of the sideband use pins SBU1, SBU2 of the sideband use pin set SBUS, and couples the other one of the sideband use pins SBU1, SBU2 to a reference ground AGND. Herein, the reference ground AGND can be the same as or different from the reference ground GND.

By disposing the first channel selector 150 and the second channel selector 160, the electronic accessory apparatus 100 of an embodiment of the present invention can provide a plurality of channels to receive audio input signals (e.g. the audio input signals MICL, MICR and HSMIC). Thus, a requirement of high quality audio signal can be satisfied.

The second channel selector 160 is the same as the first channel selector 150, such that it can set the sideband use pin SBU1 or SBU2 to receive the audio input signal HSMIC according to different modes, and connect the microphone to the type C USB connector 110 in a forward direction or a reverse direction, by which a transmission operation of the audio input signal HSNIC can be performed effectively.

Figure 2A:
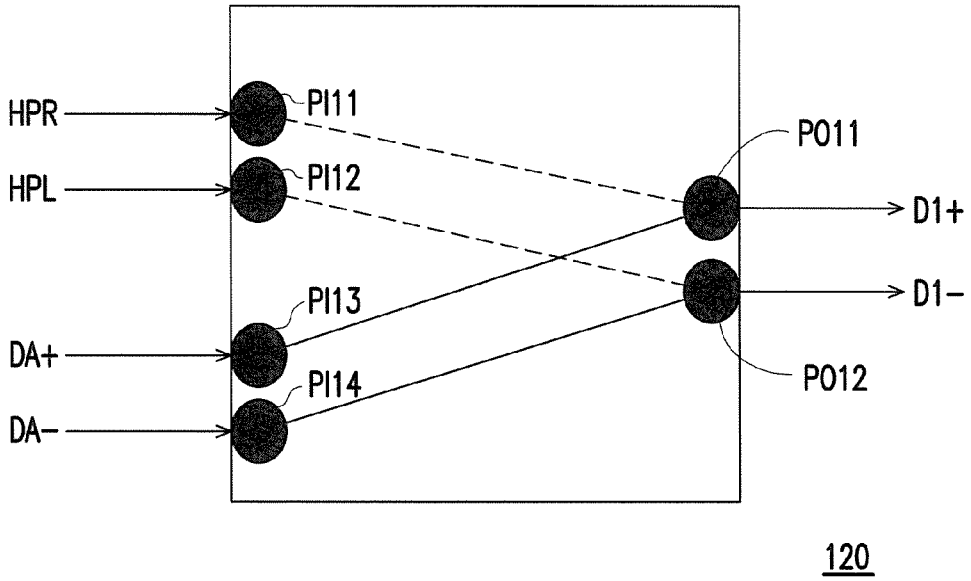
FIG. 2A and FIG. 2B are schematic diagrams respectively illustrating switch circuits according to an embodiment of the present invention.
Figure 2B:
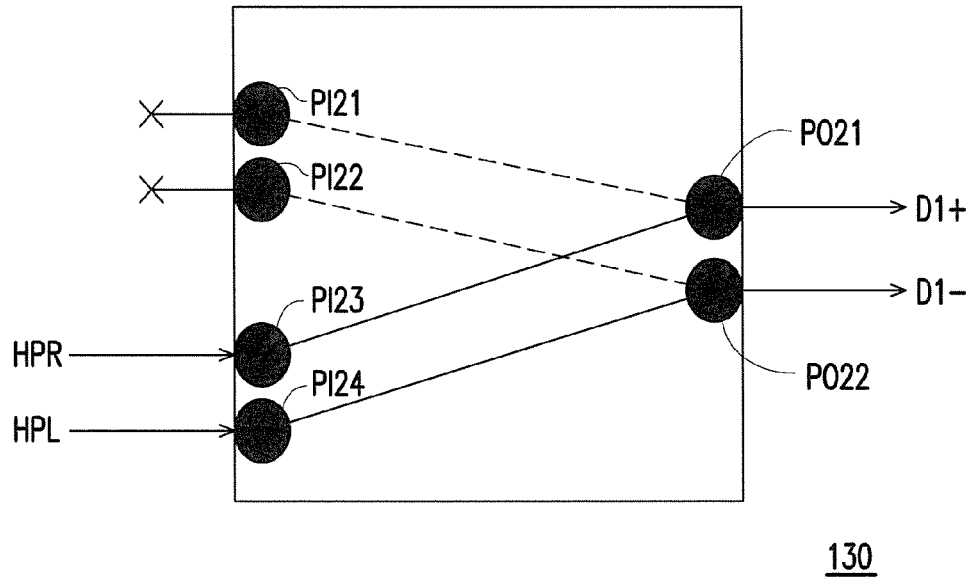

Hereafter, please refer to FIG. 2A and FIG. 2B, FIG. 2A and FIG. 2B are schematic diagrams respectively illustrating switch circuits according to an embodiment of the present invention. In FIG. 2A, the first switch circuit 120 is a circuit having 4 input pins PI11-PI14 and 2 output pins PO11-PO12. In particular, the output pins PO11-PO12 can be selected and electrically connected to the input pins PI11-PI12 respectively via the first switch circuit 120 according to the control signal CTR1, or the output pins PO11-PO12 can be selected and electrically connected to the input pins PI13-PI14 respectively by the first switch circuit 120 according to the control signal CTR1. Specifically, in the present embodiment, audio output signals HPR, HPL and data signals DA+, DA− are received by the input pins PI11-PI14 respectively. When the output pins PO11-PO12 are selected and electrically connected to the input pins PI11-PI12 respectively by the first switch circuit 120 according to the control signal CTR1, the audio output signals HPR, HPL are transmitted to the output pins PO11-PO12 respectively. Correspondingly, when the output pins PO11-PO12 are selected and electrically connected to the input pins PI13-PI14 respectively by the first switch circuit 120 according to the control signal CTR1, the data signals DA+, DA− are transmitted to the output pins PO11-PO12 respectively. Particularly, the data signals DA+, DA− can be differential signals.

In FIG. 2B, the second switch circuit 130 and the first switch circuit 120 have the same circuit structure. Specifically, the second switch circuit 130 may have 4 output pins PI21-PI24 and 2 output pins PO21-PO22. It should be noted that, the input pins PI21-PI22 of the second switch circuit 130 is in a state of electrically floating, and do not receive any signal. The input pins PI23-PI24 of the second switch circuit 130 receive the audio output signals HPR, HPL respectively. Considering operational details, a switch operation of the second switch circuit 130 can be the same as the first switch circuit 12, and synchronized with the first switch circuit 120. Specifically, when the input pins PI11-PI12 of the first switch circuit 120 are coupled to the output pins PO11-PO12 of the first switch circuit 120, the input pins PI21-PI22 of the second switch circuit 130 are simultaneously coupled to the output pins PO21-PO22 of the second switch circuit 130. In the same time, the data signals DA+, DA− are respectively transmitted to data pins D1+, D1− via the first switch circuit 120. The input pins PI21-PI22 based on the second switch circuit 130 are electrically floating, thus a transmission operation of the data signals DA+, DA− would not be interfered.

Moreover, when the input pins PI13-PI14 of the first switch circuit 120 are coupled to the output pins PO11-PO12 of the first switch circuit 120, the input pins PI23-PI24 of the second switch circuit 130 are simultaneously coupled to the output pins PO21-PO22 of the second switch circuit 130. In the same time, the first and second switch circuits 120, 130 perform transmission operations of the audio output signals HPR, HPL simultaneously. In addition, by the first and second switch circuits 120, 130, an equivalent impedance of a transmission path of the audio output signals HPR, HPL is lowered, so that a transmission quality can be improved effectively.

Figure 3:
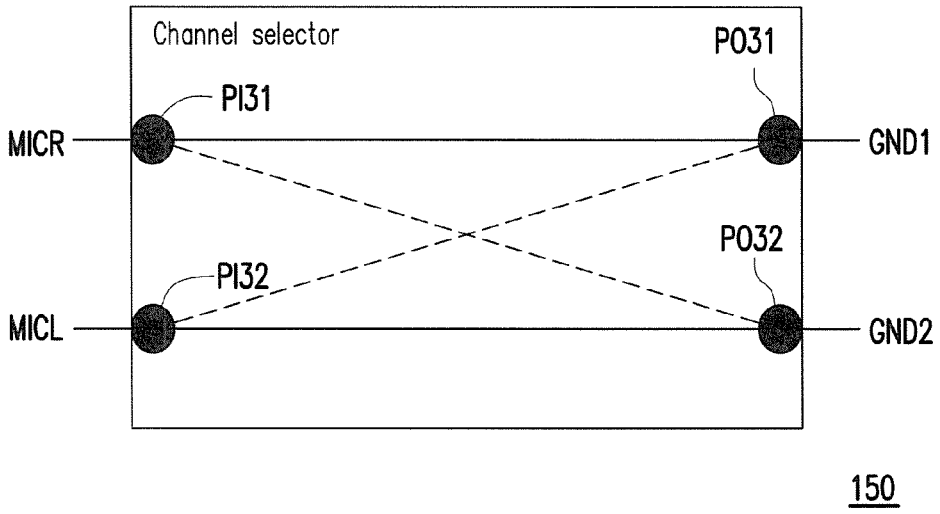
FIG. 3 is a schematic diagram illustrating a channel selector according to an embodiment of the present invention.

Afterward, please refer to FIG. 3, FIG. 3 is a schematic diagram illustrating a channel selector according to an embodiment of the present invention. The first channel selector 150 has 2 input pins PI31-PI32 and 2 output pins PO31-PO32. The input pins PI31-PI32 are respectively connected to the output pins PO31-PO32 via the first channel selector 150 in a first mode, or the input pins PI32-PI31 are respectively connected to the output pins PO31-PO32. Considering a setting manner of the first mode and the second mode, it can be determined by a connection direction of the type C USB connector and an external apparatus (e.g. a microphone). Considering the manner of determining the type C USB connector and the external apparatus are connected either in a forward direction or in a reverse direction, manners well known by the person having ordinary skill in the art can be adopted, the present invention is not limited thereto.

In the present embodiment, in the first mode, the ground pin GND1 of the type C USB connector can be connected to the input pin PI31 of the first channel selector 150 by the first channel selector 150, and the ground pin GND2 of the type C USB connector can be connected to the input pin PI32 of the first channel selector 150 by the first channel selector 150. As a result, the audio input signals MICR, MICL can be respectively transmitted to the output pins PI31, PI32 by the first channel selector 150. In addition, in the second mode, the ground pin GND1 of the type C USB connector can be connected to the output pin PI32 of the first channel selector 150 by the first channel selector 150, and the ground pin GND2 of the type c USB connector is connected to the output pin PI31 of the first channel selector 150 by the first channel selector 150. As a result, the audio input signals MICR, MICL can be respectively transmitted to the output pins PI31, PI32 from the ground pins GND2, GND1 via the first channel selector 150.

Figure 4:
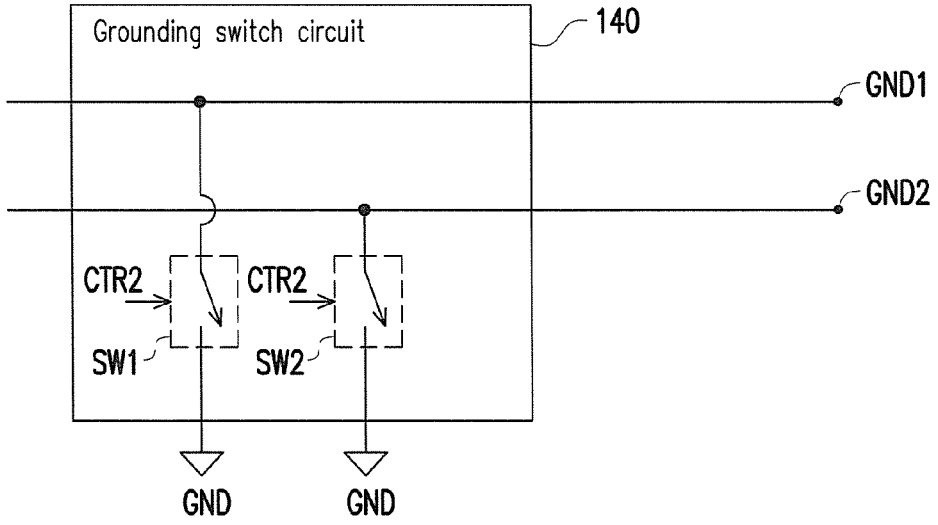
FIG. 4 is a schematic diagram illustrating a grounding switch circuit according to an embodiment of the present invention.

Please refer to FIG. 4, FIG. 4 is a schematic diagram illustrating a grounding switch circuit according to an embodiment of the present invention. The grounding switch circuit 140 includes switch devices SW1, SW2. The switch device SW1 is coupled between the ground pin GND1 and the reference ground GND, and the switch device SW2 is coupled between the ground pin GND2 and the reference ground GND. The switch devices SW1, SW2 are controlled by the control signal CTR2. The control signal CTR2 can be set according to whether an additional transmission channel of an audio input signal is provided in the electronic accessory apparatus. When the additional transmission channel of the audio input signal is required in the electronic accessory apparatus, the switch devices SW1, SW2 can be disconnected according to the control signal CTR2, and the ground pins GND1, GND2 can be applied for a signal transmission operation. On the other hand, when the additional transmission channel of the audio input signal is not required in the electronic accessory apparatus, the switch devices SW1, SW2 can be turned on according to the control signal CTR2, and the ground pins GND1, GND2 are actually grounded.

Figure 5:
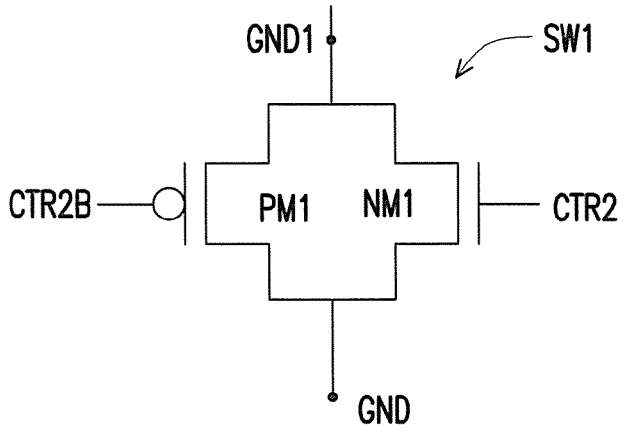
FIG. 5 is a schematic diagram illustrating an implementation manner of a switch device according to an embodiment of the present invention.

Considering an implementation manner of the switch devices SW1, SW2, please refer to FIG. 5, which is a schematic diagram illustrating an implementation manner of a switch device according to an embodiment of the present invention. Taking the switch device SW1 as an example, the switch device SW1 includes a P-type transistor PM1 and an N-type transistor NM1. A first end of the P-type transistor PM1 is coupled to the ground pin GND1 of the type C USB connector, a second end of the P-type transistor PM1 is coupled to the reference ground GND. A first end and a second end of the N-type transistor NM1 are respectively coupled to the first end and the second end of the P-type transistor PM1. In other words, the P-type transistor PM1 and the N-type transistor NM1 are in a state of parallel coupling. In addition, the N-type transistor NM1 is controlled by the control signal CTR2, and the P-type transistor PM1 is controlled by a reverse control signal CTR2B. Each of the control signal CTR2 and the reverse control signal CTR2B is the reverse of the other. As a result, the states of tuned-on or cut-off of the P-type transistor PM1 and the N-type transistor NM1 are consistent.

By the P-type transistor PM1 and the N-type transistor NM1 coupled in parallel, a very small impedance can be provided between the ground pin GND1 of the type C USB connector and the reference ground GND when the switch device SW1 is turned on, so as to enhance a ground connection of the type C USB connector.

Figure 6:
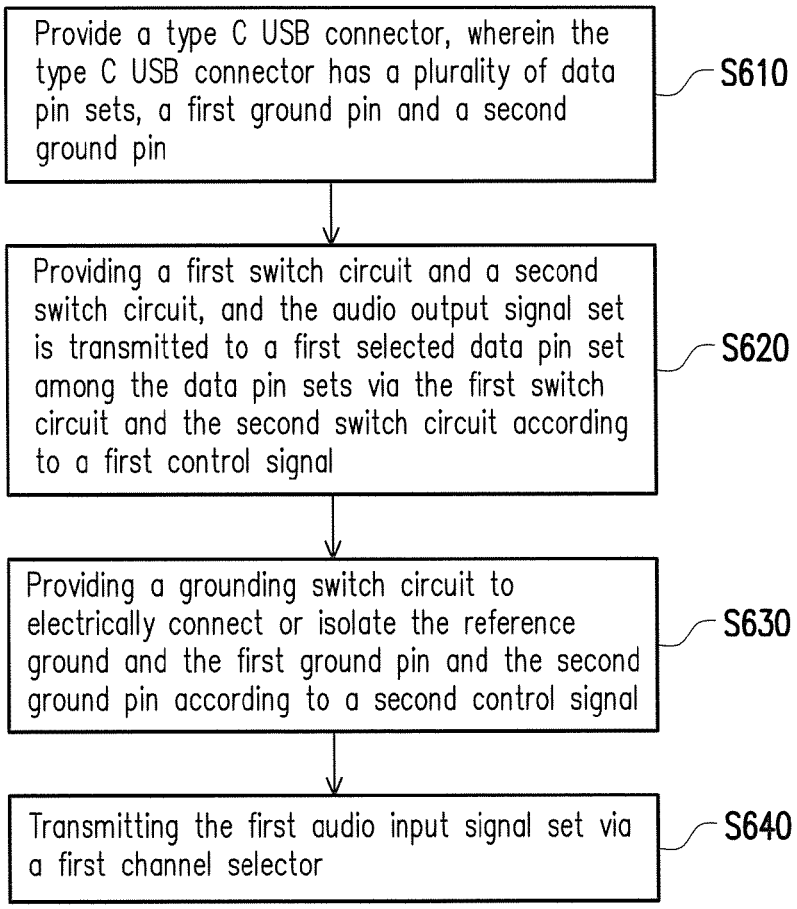
FIG. 6 is a flow diagram illustrating an audio signal transmission method according to an embodiment of the present invention.

Afterward, please refer to FIG. 6, FIG. 6 is a flow diagram illustrating an audio signal transmission method according to an embodiment of the present invention. In particular, the type C USB connector is provided in a step S610, wherein the type C USB connector has a plurality of data pin sets, the first ground pin and the second ground pin. In a step S620, the first switch circuit and the second switch circuit are provided to receive the audio output signal set together, and the audio output signal set is transmitted to a first selected data pin set among the data pin sets via the first switch circuit and the second switch circuit according to the first control signal. Then, in a step S630, the grounding switch circuit is provided to electrically connect or isolate the reference ground and the first ground pin and the second ground pin according to the second control signal. In addition, in a step S640, the first audio input signal set is transmitted via the first channel selector.

Concerning implementation details of each of the above-mentioned steps have been elaborately described in the afore-mentioned embodiments and implementation manners, they would not be described again here.

As above, a plurality of switch circuits are provided in the present invention, and the switch circuits are coupled in parallel when transmitting an audio output signal set, so as to lower impedance of transmission channel. Moreover, a grounding switch circuit is further provided in the present invention, so as to select either grounding the type C USB connector or electrically isolating the type C USB connector from a reference ground. In addition, when a ground pin of the type C USB connector is electrically isolated from the reference ground, the ground pin of the type C USB connector can be applied to transmit an audio input signal set, and thus increase the number of channels that can transmit an audio input signal in an electronic accessory apparatus.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An electronic accessory apparatus, comprising:

a type C universal serial bus connector, having a plurality of data pin sets, a first ground pin and a second ground pin;

a first switch circuit, coupled to a first selected data pin set among the data pin sets, and transmitting a data signal set or an audio output signal set to the first selected data pin set according to a first control signal;

a second switch circuit, coupled to the first selected data pin set, and transmitting the audio output signal set to the first selected data pin set according to the first control signal;

a grounding switch circuit, coupled between the first ground pin, the second ground pin and a reference ground, and being turned on or cut off according to a second control signal; and a first channel selector, coupled to the first ground pin and the second ground pin, and setting a signal transmission relation between a first audio input signal set, the first ground pin and the second ground pin.

2. The electronic accessory apparatus according to claim 1, wherein when the first switch circuit transmits the audio output signal set to the first selected data pin set according to the first control signal, the second switch circuit transmits the audio output signal set to the first selected data pin set according to the first control signal.

3. The electronic accessory apparatus according to claim 2, wherein the audio output signal set comprises a first audio output signal and a second audio output signal, the first audio output signal and the second audio output signal are respectively transmitted to a first data pin and a second data pin of the first selected data pin set.

4. The electronic accessory apparatus according to claim 1, wherein when the first audio input signal set is transmitted via the first channel selector, the grounding switch circuit is cut off according to the second control signal, when the first audio input signal set is not transmitted via the first channel selector, the grounding switch circuit is turned on according to the second control signal.

5. The electronic accessory apparatus according to claim 1, wherein a first audio input signal and a second audio input signal of the first audio input signal set are respectively received from the first ground pin and the second ground pin via the first channel selector in a first mode.

6. The electronic accessory apparatus according to claim 5, wherein the second audio input signal and the first audio input signal of the first audio input signal set are respectively received from the first ground pin and the second ground pin via the first channel selector in a second mode.

7. The electronic accessory apparatus according to claim 1, wherein the grounding switch circuit comprises:

a first switch device, connected between the first ground pin and the reference ground, and turned on or cut off according to the second control signal; and a second switch device, connected between the second ground pin and the reference ground, and turned on or cut off according to the second control signal.

8. The electronic accessory apparatus according to claim 7, wherein each of the first switch device and the second switch device comprises:

a N-type transistor, wherein a first end of the N-type transistor is coupled to the first ground pin or the second ground pin, a second end of the N-type transistor is coupled to the reference ground, and a control end of the N-type transistor receives the second control signal; and a P-type transistor, wherein a first end and a second end of the P-type transistor are respectively coupled to the first end and the second end of the N-type transistor, and a control end of the P-type transistor receives a reverse second control signal.

9. The electronic accessory apparatus according to claim 1, wherein an output end of the second switch circuit is further connected to a second selected data pin set.

10. The electronic accessory apparatus according to claim 1, further comprising:

a second channel selector, coupled to a sideband use pin set of the type C USB connector, and sets a signal transmission relation between a second audio input signal set, a ground voltage and the sideband use pin set.

11. An audio signal transmission method, comprising:

providing a type C USB connector, wherein the type C USB connector has a plurality of data pin sets, a first ground pin and a second ground pin;

providing a first switch circuit and a second switch circuit to receive an audio output signal set together, and transmitting the audio output signal set to a first selected data pin set among the data pin sets via the first switch circuit and the second switch circuit according to a first control signal;

providing a grounding switch circuit to electrically conduct or isolate a reference ground and the first ground pin and the second ground pin according to a second control signal; and transmitting a first audio input signal set via a first channel selector.

12. The audio signal transmission method according to claim 11, further comprising:

providing the second switch circuit to transmit the audio output signal set to a second selected data pin set among the data pin sets.

13. The audio signal transmission method according to claim 11, wherein the step of transmitting the first audio input signal set via the first channel selector comprises:

electrically isolating the reference ground and the first ground pin and the second ground pin via the grounding switch circuit according to the second control signal when the first audio input signal set is transmitted via the first channel selector, electrically conducting the reference ground and the first ground pin and the second ground pin via the grounding switch circuit according to the second control signal when the first audio input signal set is not transmitted via the first channel selector.

* * * * *